US007731490B2

(12) United States Patent
Reale et al.

(10) Patent No.: US 7,731,490 B2
(45) Date of Patent: Jun. 8, 2010

(54) SELF-CLEANING BURNER SYSTEM FOR HEATERS AND BURNERS

(75) Inventors: Anthony F. Reale, Barnstead, NH (US); David W. Tucci, Washington, NH (US); George McMahon, Manchester, NH (US); John P. Gardner, Franklin, NH (US); Francis H. Ingram, Westford, NH (US); Steven J. Savage, Concord, NH (US); Nathaniel A. Lambert, Hooksett, NH (US); Martin W. Lawrence, Chichester, NH (US)

(73) Assignee: Pitco Frialator, Inc., Concord, NH (US)

( * ) Notice: Subject to any disclaimer, the term of this patent is extended or adjusted under 35 U.S.C. 154(b) by 1056 days.

(21) Appl. No.: 11/436,460

(22) Filed: May 18, 2006

(65) Prior Publication Data

US 2006/0281033 A1 Dec. 14, 2006

Related U.S. Application Data

(60) Provisional application No. 60/683,183, filed on May 20, 2005.

(51) Int. Cl.
*C10L 10/00* (2006.01)

(52) U.S. Cl. ..... 431/3; 431/12; 431/32; 431/121

(58) Field of Classification Search ..... 431/3, 431/5, 8, 12, 29, 32, 121, 122, 123
See application file for complete search history.

(56) References Cited

U.S. PATENT DOCUMENTS 5,662,465 A * 9/1997 Kano ..... 431/12
6,164,956 A 12/2000 Payne et al.
6,619,951 B2 9/2003 Bodnar et al.

(Continued)

FOREIGN PATENT DOCUMENTS

FR 2 788 838 7/2000

(Continued)

OTHER PUBLICATIONS

International Preliminary Report on Patentability for International Application No. PCT/US2006/019600, dated Nov. 23, 2007.

(Continued)

*Primary Examiner*—Alfred Basichas
(74) *Attorney, Agent, or Firm*—Brinks Hofer Gilson & Lione

(57) ABSTRACT

A self-cleaning burner system incorporates an automatic clean cycle when the burner is started up. Cycles may be programmed for once-a-day cleaning cycle or for other desired interval. On start-up, the cycle routes a small amount of fuel to the burner for ignition inside the burner to clean the burner surfaces. The system incorporates an igniter for fast, routine, and safe ignition of the fuel. Thus, small amounts of debris that accumulate on a surface burner are automatically ignited when the burner is started, keeping the burner clean and operating at a high state of efficiency at all times. The self-cleaning burner system may be incorporated into a fryer or other heating appliance for reliable, efficient operation.

13 Claims, 5 Drawing Sheets

U.S. PATENT DOCUMENTS 6,694,926 B2 2/2004 Baese et al.

FOREIGN PATENT DOCUMENTS

| | | |
|---|---|---|
| GB | 1105160 | 3/1968 |
| GB | 1444914 | 8/1976 |
| GB | 2 149 082 | 6/1985 |
| JP | 5-10506 | 1/1993 |

OTHER PUBLICATIONS

Written Opinion of the International Searching Authority for International Application No. PCT/US2006/019600, dated Nov. 23, 2007.

Weber, E.J., Minimizing Lint Stoppage at Atmospheric Gas Burner Ports, published Mar. 1960.

Pro Series Gas Fryers, Installation and Operation Manual, Jan. 2005.

English Translation of Previously Cited JP 05010506 to Tsutsunaka.

IPRP for related PCT/US2006/019600 dated Dec. 6, 2007.

Australian Examination Report dated Aug. 31, 2009 for related AU 2006252004.

Canadian Office Action dated Aug. 17, 2009 for related CA 2,609,094.

Chinese Office Action dated Nov. 27, 2009 for related CN 200680022103.1 and summary English translation thereof.

* cited by examiner

900

SELF-CLEANING BURNER SYSTEM FOR HEATERS AND BURNERS

CROSS REFERENCE TO RELATED APPLICATIONS

This application claims priority from provisional application Ser. No. 60/683,183, filed on May 20, 2005, which is fully incorporated by reference herein.

TECHNICAL FIELD

The technical field of the invention is burners, and appliances using burners, such as heaters, stoves, fryers, and ovens, and other containers for heating objects.

BACKGROUND

Burners are used in a great variety of applications for heating water, warming homes, cooking food, and in a more general manner, generating and using heat. A great variety of burners are used in everyday life, including, but not limited to, water heaters, stoves, ovens, space heaters, process heaters, deep-fat or other fryers, and so forth. One problem in common with all burners is that residue tends to build up on the surfaces of the burners and associated parts.

There is usually little build-up in the areas of the burners that become very hot, such as the combustion chamber. There are additionally many burners which themselves do not become very hot, such as a venturi which combines fuel and air into a fuel/air mixture for combustion just outside the burner. However, the surrounding parts, such as those that supply fuel and oxygen, are susceptible to build-up of undesirable deposits. The problem is described in a paper published by the American Gas Association (AGA) Labs in 1960, entitled, "Minimizing Lint Stoppage of Atmospheric Gas Burner Ports." Proposed solutions include filtering incoming air and operating the burner at a sufficiently high temperature that the lint-accumulating side of the burner inlet port stays hot enough to incinerate incoming lint when it strikes the port. See pp. 9-10 of the AGA report.

For example, in a typical atmospheric venturi-type burner using natural gas (primarily methane), a given volume of fuel may require as much as ten volumes of air for proper combustion. This means that a great volume of unfiltered air may pass through the venturi, or other burner, and may mean that many contaminants in the air may have an opportunity to accumulate dirt, lint, or other undesirable residue.

Typical atmospheric burners, and even many forced-draft burners, do not use filtered air. Therefore, a very large volume of air will pass through the burner and may include many impurities. For example, in a home kitchen or in a restaurant, the air may include very minor amounts of lint, dust, particulates, food vapors, oil vapors, grease vapors, and the like. While the concentration of such contaminants is small, their cumulative effect over periods of time may be great. These contaminants may deposit on the outer and inner surfaces of a burner, such as the inlet plumbing, the exterior of the burner, the inside of a venturi, and the like.

Alert owners and operators will recognize the need to clean these surfaces in order to keep clear the pathways for fuel and air or oxygen. Clean burners naturally tend to operate at a higher efficiency and will be more efficient in transferring heat from the burner to the load or object(s) which is being heated. If a burner could clean itself, it would relieve owners and operators from the necessity of having to stop heating operations in order to clean the burners. It would also help to insure that the burner operates at a high state of efficiency, and would thus at least potentially save energy and energy costs.

BRIEF SUMMARY

One embodiment of our invention is a self-cleaning burner system. The self-cleaning burner system includes at least one burner in which combustion normally takes place outside the burner, a first valve for connection to a source of fuel, and a first tube having at least one fuel control orifice near the at least one burner, wherein the first tube is connected to the first valve, an ignition source; and a controller for controlling an operation of the self-cleaning burner system, wherein the controller opens the valve for a period of time and admits fuel into the first tube and orifice for ignition by the ignition source inside the burner to clean the burner.

Another embodiment is a self-cleaning burner system. The self-cleaning burner system includes at least one burner, a runner tube near the at least one burner, the runner tube further including at least one orifice near each of the at least one burners. The system also includes a valve for connecting to a source of fuel, the valve connected to the runner tube, a source of ignition near the runner tube, and a controller for controlling an operation of the self-cleaning burner system, wherein the controller opens the valve for a brief period of time and admits a small amount of fuel into the runner tube, the ignition source ignites the fuel, and flame is supplied near a proximal end of each of the at least one burners for self-cleaning of each of the at least one burners.

Another embodiment is a method for cleaning a burner using a self-cleaning burner system in which combustion normally takes place outside the burner. The method includes steps of providing a small amount of fuel near at least one burner, igniting the fuel using an ignition source, controlling burning of the fuel to clean an inside of the at least one burner, and allowing the burning to extinguish and allowing the at least one burner to cool.

Another embodiment is a method of cleaning a burner in which combustion normally takes place outside the burner using a self-cleaning burner system. The method includes steps of providing a small amount of gas near at least one burner, the amount controlled by limiting a flow of the gas for a brief period of time, and providing oxygen and an ignition source near the at least one burner. The method also includes steps of controlling ignition of the gas such that the gas burns primarily inside the burner, cleaning the burner, allowing the burning to extinguish, and allowing the at least one burner to cool before further use of the at least one burner.

DETAILED DESCRIPTION OF THE DRAWINGS AND THE PRESENTLY PREFERRED EMBODIMENTS

Figure 1:
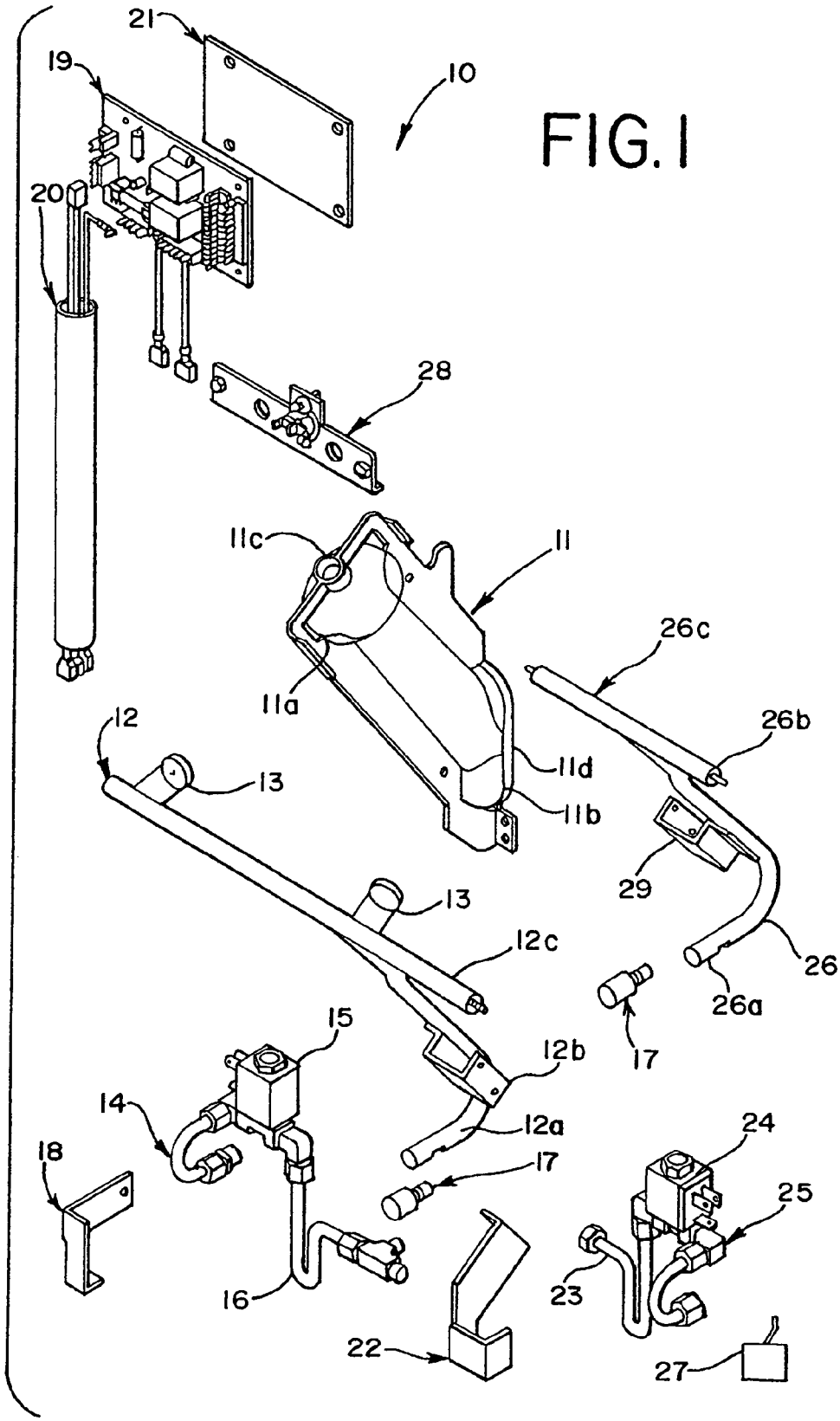
FIG. 1 is an exploded view of an embodiment of a self-cleaning burner system.

There are many embodiments of the present invention that are efficiently and easily used in constructing self-cleaning burners and in adapting existing burners to self-cleaning burners. FIG. 1 is an exploded view of one embodiment. The self-cleaning burner system 10 of FIG. 1 includes at least one burner 11, suitable for burning gaseous fuels, such as natural gas (primarily methane) and LP gas. One example of such a burner is burner part number B8041901, made by Pitco Frialator, Inc., Concord, N.H. This burner has a proximal end 11*a*, a distal end 11*b*, and a fitting 11*c* for location of a nozzle or orifice from a source of fuel or gas. The proximal end is wide, and narrows quickly to a cross section having the general form of a circle, an oval, or a rounded rectangle. The proximal end 11*a* is the end into which fuel or gas is injected from a fuel tube. The distal end 11*b*, which may include a face plate, is the end of the tube from which the fuel/air mixture leaves in order to be combusted to produce heat. In burner 11, there is also structure or bracket 11*c* into which a nozzle or orifice from a fuel tube will be placed.

As is well known to those in the field, the name "burner" is a misnomer, since no burning normally takes place inside the "burner." Rather, the burner may be thought of as similar to a carburetor, in that the function of the burner is to accept the fuel flow, to entrain considerable quantities of air, and to continuously deliver a well-mixed quantity of fuel and air to a combustion chamber or flame tube immediately downstream of the burner. Because burners are not themselves normally used for combustion, they may accumulate the dirt and deposits to which embodiments of the present invention are directed.

Self-cleaning burner system 10 also includes main burner piping 12 and a nozzle or orifice 13 for each burner 11 used in the self-cleaning burner system. The piping includes a feed portion 12*a* and a discharge portion 12*c* near nozzles or orifices 13. Typical module burner systems use two or four burners. In this example, there is one burner 11 on each side of feed portion 12*a*, although more burners could be used. A source of gas or fuel is connected to piping 14 and main control valve 15. Outlet tubing 16 is connected to feed portion piping 12*a*. Because the flow of gas or fuel is typically low, there may be fuel-flow limiting orifice 17 introduced into piping 12. Note that flow-limiting orifices 13 and 17 are typically discrete components, manufactured to exacting specifications for precise control of fuel flow. The term orifice is otherwise used herein to denote an opening, such as an opening or a hole in piping or tubing.

In addition to the main burner piping, the self-cleaning burner system may include additional piping to ignite the fuel near the proximal end of the burner, thus cleaning the burner. Downstream of main valve 15 may be an additional valve 24, connected with inlet piping or tubing 23 and outlet piping or tubing 25. The outlet piping or tubing may be connected via an additional limiting orifice 17 to self-cleaning burner tubing 26, including tubing proximal end 26*a* and distal end 26*b*. Alternatively, valve 24 may be connected directly, in parallel with valve 15, to inlet tubing 14. Distal end 26*b* may be installed near discharge tubing 12*c*, and may be run parallel with tubing 12*c*. For instance, if there are four burners 11, and four nozzles or orifices 13 discharging gas or fuel from tubing 12*c*, distal end 26*b* is preferably near all four nozzles. Tube 26 includes a large number of perforations or holes 26*c*, in order for gas entering tube 26 to escape and be available in the immediate vicinity of tube 26.

The self-cleaning burner system preferably includes a controller 19 and a high-limit temperature sensing element 28 for sensing the temperature near the proximal end of at least one burner 11. The system preferably includes a wiring harness 20 for connecting the valves 15, 24. The controller may be mounted to the self-cleaning burner system using a thermal and electrical insulation pad 21. In addition, the components described above may be mounted in a burner area (not shown) of a larger assembly using one or more brackets 18, 22, 29, as well as additional brackets as needed. In addition, an ignition source 27 may be mounted near a proximal end 26*a* of the burner tubing 26.

The temperature sensing elements used in the self-cleaning burner system may include one or more thermocouples, thermistors, or any other suitable sensor for sensing a temperature and reporting to controller 19. If preferred, a local temperature indicator may also be used, such as a thermocouple or thermistor read-out for the convenience of the operator or maintenance personnel.

The self-cleaning burner system of FIG. 1 has several options for its operation, but one preferred method is described herein. The burner system may be installed in a commercial fryer system, such as a fryer system used for deep-fat frying of French fries or chicken. In typical operation, the burners, not being part of the food contact area, are not often cleaned. Therefore, in one preferred method of operation, a user starts the fryer, for which a first step is to light the burner or burners and heat the cooking oil, shortening, or other medium used for cooking. This operation typically takes about 10-12 minutes and is performed at the start of the day. Because this operation is thus not typically time-sensitive, it may be an opportune time to incorporate a self-cleaning cycle for the burners.

A user starts the fryer and starts the burners. Upon start-up, the burner controls verify that there is no high temperature with temperature element 28 or any other temperature elements or indicators that form part of the system, such as temperature sensors in or near the fry tank or the combustion area. Valve 15 opens and gas from a source of gas flows in piping 12, through nozzles or orifices 13 and into burner(s) 11, entraining gas. Combustion begins downstream of the burner(s) via normal operation of the system. Immediately after this start-up, valve 24 opens for a brief period of time, preferably about 5-20 seconds, more preferably about 6-10 seconds. Gas flows in piping 26 and through perforations 26*c*. A few moments after gas flows in piping 26, ignition source 27 may be activated in order to ignite the gas flowing in piping 26 and flowing out through perforations 26*c*.

The gas flowing in piping 26 will not burn inside the tubing, but burns outside the tubing, where atmospheric air or oxygen is available. Thus, a flame front that begins with ignition source 27 near proximal end 26*a* travels rapidly from perforation to perforation in piping 26, and reaches distal end 26*b*. When the flame front reaches distal end 26*b*, the flames will ignite fuel or gas flowing from orifices 13. The flames will burn and clean at least the inside of burners 11. If there is sufficient gas buildup, the outside of burners 11 may also be cleaned when the flame reaches the nozzles. A few moments later, valve 24 has reached the end of its programmed brief period of time and closes, as does main valve 15. At this point, the burners have been cleaned and may be warm from their brief exposure to flame. Accordingly, a second period of time is now observed, preferably from 0.5 to 10 seconds, more preferably from 1 to five seconds, to insure that the flames are extinguished and that the temperature elements indicate a "normal" temperature, rather than a flame temperature.

If the controller is a microprocessor controller, or if solid-state electronic controls are used, the fryer and the burner may now automatically re-start, with a normal start up that does not involve a cleaning step. The cleaning cycle may be performed as often as desired, but preferably once a day, which is sufficient to keep the inside of the burners clean and free of undesirable build-up. Microprocessor controllers that may be useful in operating the self-cleaning burner system are available from a number of manufacturers. Solid state logic controllers, such as programmable logic controllers (PLCs) may be used as an alternate to microprocessor controllers. Solid state controllers typically include controllers and timers and may include relays to carry out commands from the controllers and timers.

The ignition source 27 near tubing 26 may be a pilot light, it may be a high-voltage ignition coil, or it may be a piezoelectric igniter. Any suitable source of a spark to ignite the small amount of gas from valve 24 may be used. For instance, a glow coil, a glow wire, or an ignition system may be used. In other embodiments, there may not be a specific ignition source component, but ignition may be provided by inducing a back draft or light back from the combustion zone of the heater, in which outside flame is drawn into the burner, inducing combustion of the fuel/air mixture near the inlet of the burner, rather than the more usual method of inducing combustion near the outlet end of the burner.

Figure 2:
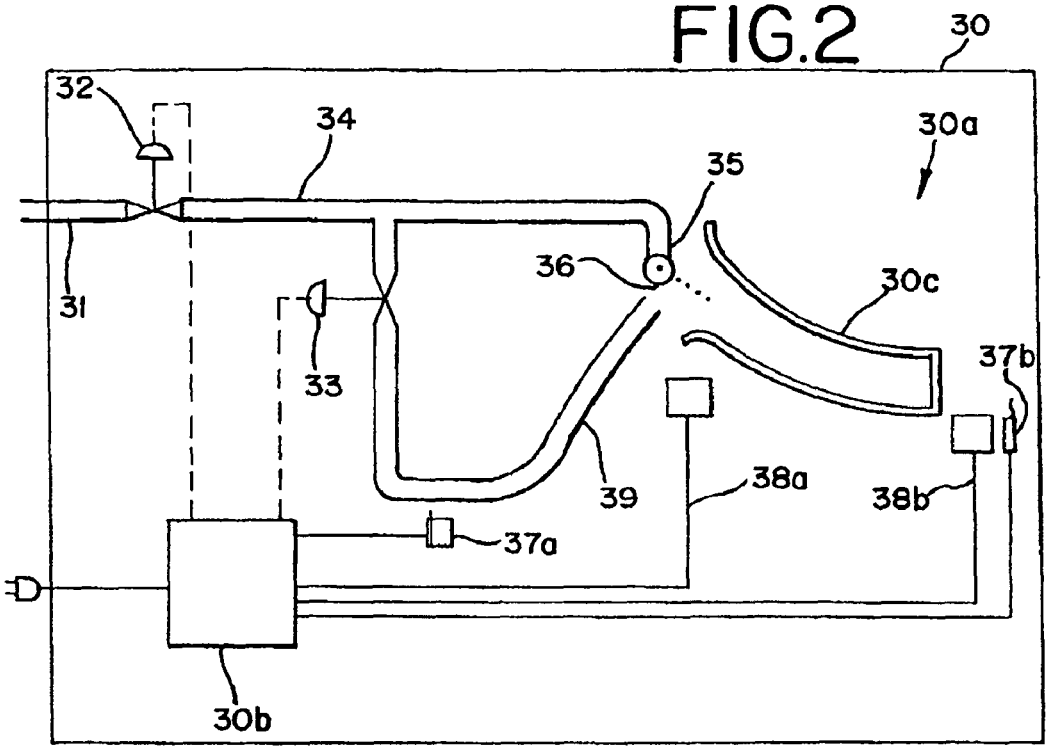
FIG. 2 is a schematic view of a second embodiment.

A second embodiment of an appliance 30 with a self-cleaning burner system 30*a* is shown in schematic form in FIG. 2. The self-cleaning burner system 30 includes controller 30*b*, burner 30*c* and piping 31 leading to a source of fuel, such as natural gas or LP gas. The source of fuel is controlled by a valve 32 controlled by a controller 30*b*. Piping or tubing 34 downstream from the valve leads to a main runner pipe 35 and a nozzle or orifice near each burner 30*c*. Orifices are preferably from about 1 mm diameter to about 4 mm diameter. Other sizes of orifices may be used. The burner 30*c* may have an igniter or source of ignition 37*b* and a temperature element 37*b* near the distal end of burner 30*c*, in the area normally used for actual combustion. As mentioned above, a typical fryer or other appliance preferably uses two or more burners.

There may be a second valve 33 in series with valve 32. Valve 33 is also controlled by the controller 30*b* as discussed above. Valves 32 and 33 may be solenoid valves or may be another type of valve suitable for controlling a flow of flammable gases. Downstream of valve 33 is a runner tube 39. Runner tube 39 includes a plurality of perforations, the perforations running in at least one row from the vicinity of a local ignition source 37*a* to a distal end of the tube near orifices 36. In addition, the self-cleaning burner system may include a high temperature element 38*a* near the proximal end of the burner, also near the distal end of runner tube 39.

As discussed above, the self-cleaning burner system 30*a* preferably executes a clean cycle every time the burner system starts up. When the user pushes the appropriate buttons on a control panel (not shown), controller 30*b* preferably executes a start cycle by checking the temperature elements 38*a*, 38*b* for safe temperatures, opens gas valve 32 and ignites burner 30*c* using igniter 37*b*. When operation is established by a high temperature at temperature element 38*b*, the self-cleaning cycle may begin by opening valve 33 for a brief period of time, preferably about 6-10 seconds. This allows gas to flow in runner tube 39 for ignition by ignition source 37*a*. In one embodiment, flame will result along the outside length of runner tube 39, causing ignition of gas emerging from orifice or orifices 36. The resulting flame or burning of gas inside burner 30*c*, especially at its proximal end then results in cleaning of the burner. A few moments later, controller 30*b* closes valve 32 for a second period of time, preferably from about 0.5 seconds to about 10 seconds, until temperature element 38*a* indicates a low temperature, indicating that it is safe to re-start operation of burner 30*c* and the appliance 30 of which the burner is a part.

While it is preferable for automatic operation of the self-cleaning burner system via a solenoid valve controlled by controller 30*b*, the self-cleaning cycle may also be operated manually. For instance, instead of using a solenoid valve, a spring-operated, normally-closed manual valve may be used, the user operating the valve by depressing a push-button (in a special push button valve) or selecting a switch (in a standard or special toggle valve) manually, for brief opening of the valve for operation much as described previously for a solenoid valve. A number of such specialty valves are available from Specialty Manufacturing Co. St. Paul, Minn., USA. These valves allow the user to initiate a self-cleaning cycle manually. After the valve is opened for a brief period of time, the local ignition source ignites and the cleaning cycle proceeds as discussed above.

In another method that may be used to clean the burners, a back draft or light back of flame may be induced, burning incoming fuel at the proximal end of the burner for a brief period of time, and cleaning the burner. In this method, the burner is started in the normal manner, with combustion occurring in the normal combustion zone, distal of the distal end of the burner. The sole controlling fuel valve is then gradually closed, slowing the flow of fuel and inducing a light back into the burner itself. While light backs are normally not desired, careful control of the valve and only periodic execution of the cleaning cycle in a controlled manner helps to keep the burner at high efficiency by keeping it clean and allowing unimpeded flow of fuel and air.

Figure 3:
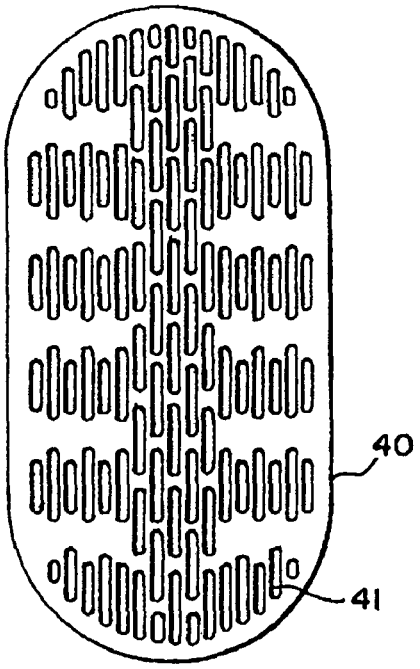
FIG. 3 is a plan view of a face plate useful in burners.

Light backs may be controlled by careful selection of one or more face plates and optionally, one or more supporting washers at the distal end of the burner. Faceplates and the washers are designed to allow the fuel/air mixture to pass through on their way to the combustion area, and to prevent flame from traveling back in the opposite direction. Selection of face plates and washers is more of an art than a science, but the principles are well known to those having skill in the burner arts. For instance, flashbacks may be prevented in burners using natural gas by using wider slots (up to about 0.055 inches wide) while a burner using propane would use narrower slots (up to about 0.025 inches wide). A faceplate useful for allowing flow of fuel/air mixtures while preventing flashbacks is presented in FIG. 3. Faceplate 40 is in the general shape of an oval or a rounded rectangle and has a plurality of slots 41. Face plate 40 will have dimensions near those of the distal end of burner. In a burner with a nominal capacity of 20,000-35,000 BTU/hr, the face plate may be about 3.5 inches high and about 1.5 inches wide in the center.

Face plates are typically from about 0.010 to about 0.020 inches thick, and may be made from stainless steels, Inconel, and other high temperature alloys. Stainless steel alloys which may be used include 304, 304L, 316, 316L, 400-series alloys, and even 600-series alloys, such as Inconel 600, 601 and 625. Face plates may even be made from cast iron, which is able to withstand high temperatures. The slots in face plates may be formed by etching, punching, nibbling, laser cutting, or any other suitable metal-removing process. Face plates need not be made from solid pieces of metal, but instead may be made from wire cloth. One suitable wire cloth is 16×16 (16 openings per inch in both the vertical and horizontal directions) wire cloth made from 0.018 inch diameter wire. This wire has about 51% open space, and is suitable for preventing flashbacks when used with propane, LP gas, butane, coal gas and manufactured gas (town gas).

Figure 4:
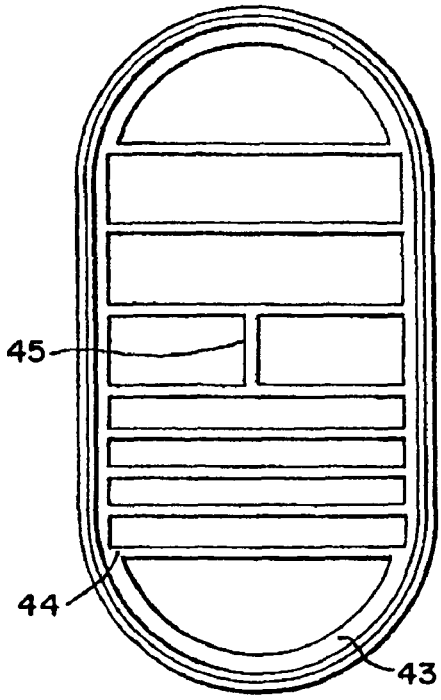
FIG. 4 is a plan view of a washer useful in burners.
Figure 5:
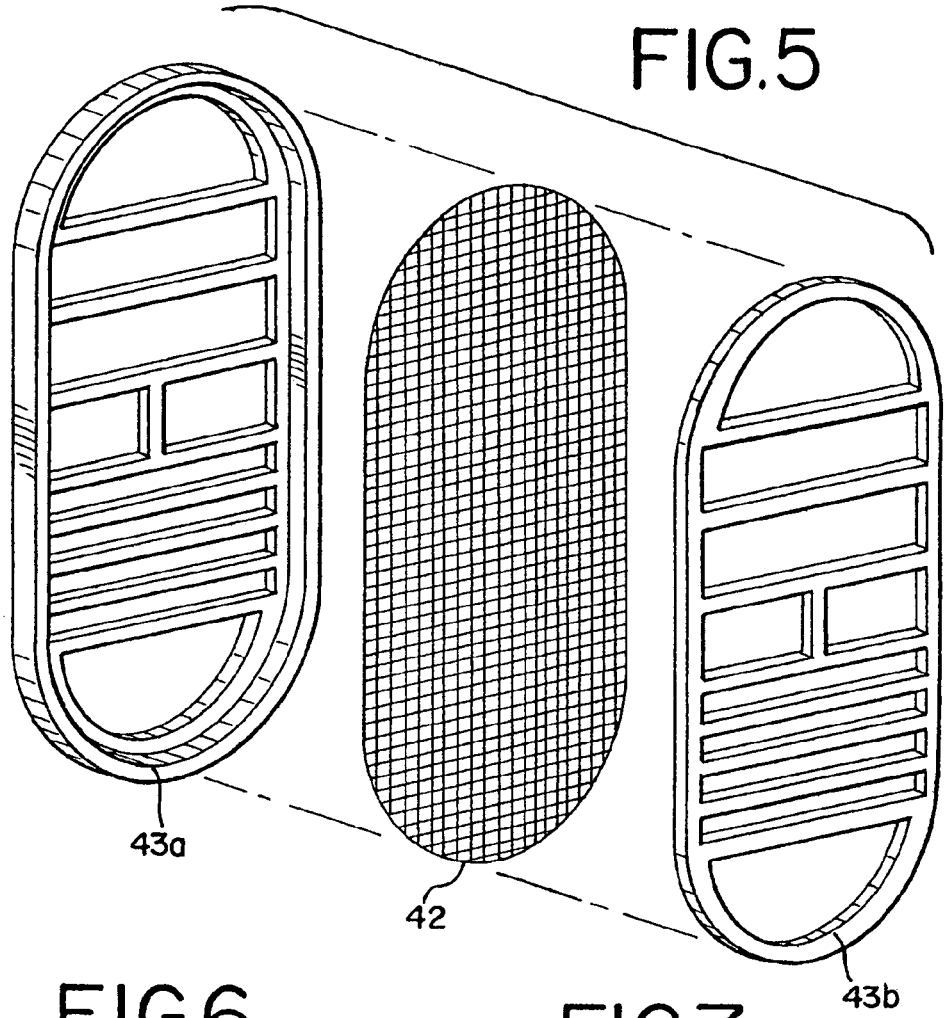
FIG. 5 is a side view of one embodiment of burners useful in embodiments of the present invention.

Face plates tend to be thin, because while flash-back prevention is desirable, the face plate must also allow free flow of the fuel/air mixture. Thus, face plates are often supported by a washer, the washer made of a thicker material and better able to resist deformation. Washers may be made from the same alloys as the face plates, but the washers are preferably thicker, from about 0.030 inches thick to about 0.060 inches thick (24 gauge to 16 gauge sheet metal). Washer structures are depicted in FIGS. 4-5. Washer 43 may include an outer periphery and one or more horizontal members 44 and, optionally, one or more vertical members 45. The washers may be assembled to the face plate by spot welding or other assembly technique. FIG. 5 depicts an exploded view of washer/face plate assembly that includes front flanged washer 43*a*, face plate 42, and rear washer 43*b*. The washer/face plate assembly is then assembled to the distal end of the burner.

Figure 6:
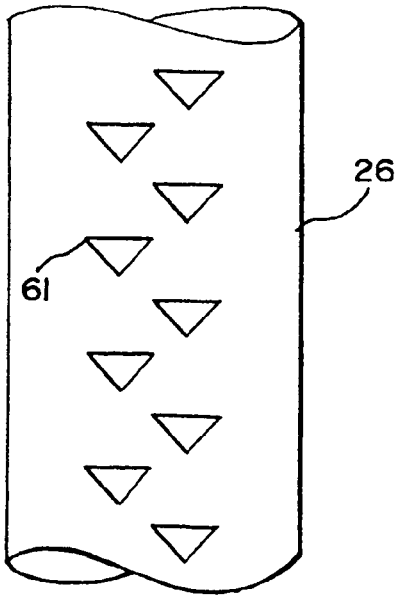
FIGS. 6-7 are plan and cross-sectional view of an embodiment.
Figure 7:
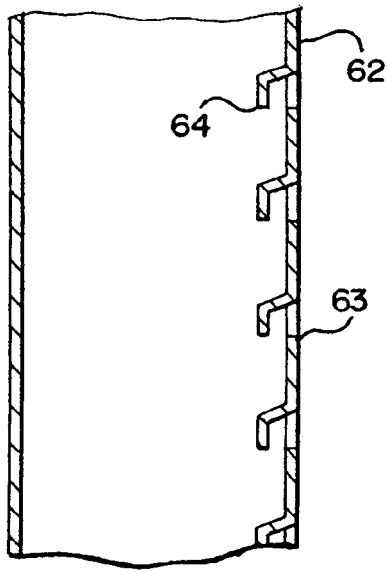

A runner tube used to ignite fuel at the proximal end of the burner and clean the burner is depicted in FIGS. 6-7. Tubing 26 is preferably about ¼ inch in diameter, and may range in size from ⅛ inch to ⅜ inch. Other sizes may be used. Tubing 26 is pierced with numerous openings 61 along its length so that gas or fuel is able to leak outside the tube and will burn along the length of the tube. In one embodiment, the openings 61 may be in two adjacent staggered rows, the centerlines of the rows separated by about ¼ inch and the openings in a row placed at a pitch of about ¼ inch, so that each opening is in actuality separated from one or two other adjacent openings by about ⅛ of an inch. Other spacings may be used. Thus, a flame that is begun at an ignition source near the proximal end 26*a* (see FIG. 1) will quickly travel along the outside of the runner tube in the direction of the arrow and will ignite gas flowing out of one or more orifices 13.

The tubing may be pierced or penetrated in several ways, such as by drilling. One way that has been found to work well is depicted in FIG. 7. Tubing 62 has been provided with a plurality of openings 63 by a process that may be though of as similar to that used by an old-time beer-can opener—i.e., the metal is pierced at one end and bent under, leaving a triangular flute 64, with a sharp point at one end. If the sharp end is nearer the direction of flow of the gas, the flute tends to redirect flow of a small portion of the gas to an outside of the tube. Such flutes may be formed by a rotary punch and die in which the punch penetrates into the metal to a depth only two or three times the thickness of the metal. Thus, if 20 gauge 304 stainless steel (about 0.036 inches thick) is used, a triangular-shaped punch will only penetrate about 0.072 to about 0.100 inches into the metal. After punching, the metal may be cleaned or deburred and then rolled or formed into tubing. Other processes may be used, such as by drilling holes in sheet metal or in tubing, or by using different processes to punch apertures in the tubing. Any process which allows the gas to escape the tubing and burn outside the tubing, carrying a flame to the proximal end of the burner and igniting the fuel near the proximal end of the burner is suitable.

Figure 8:
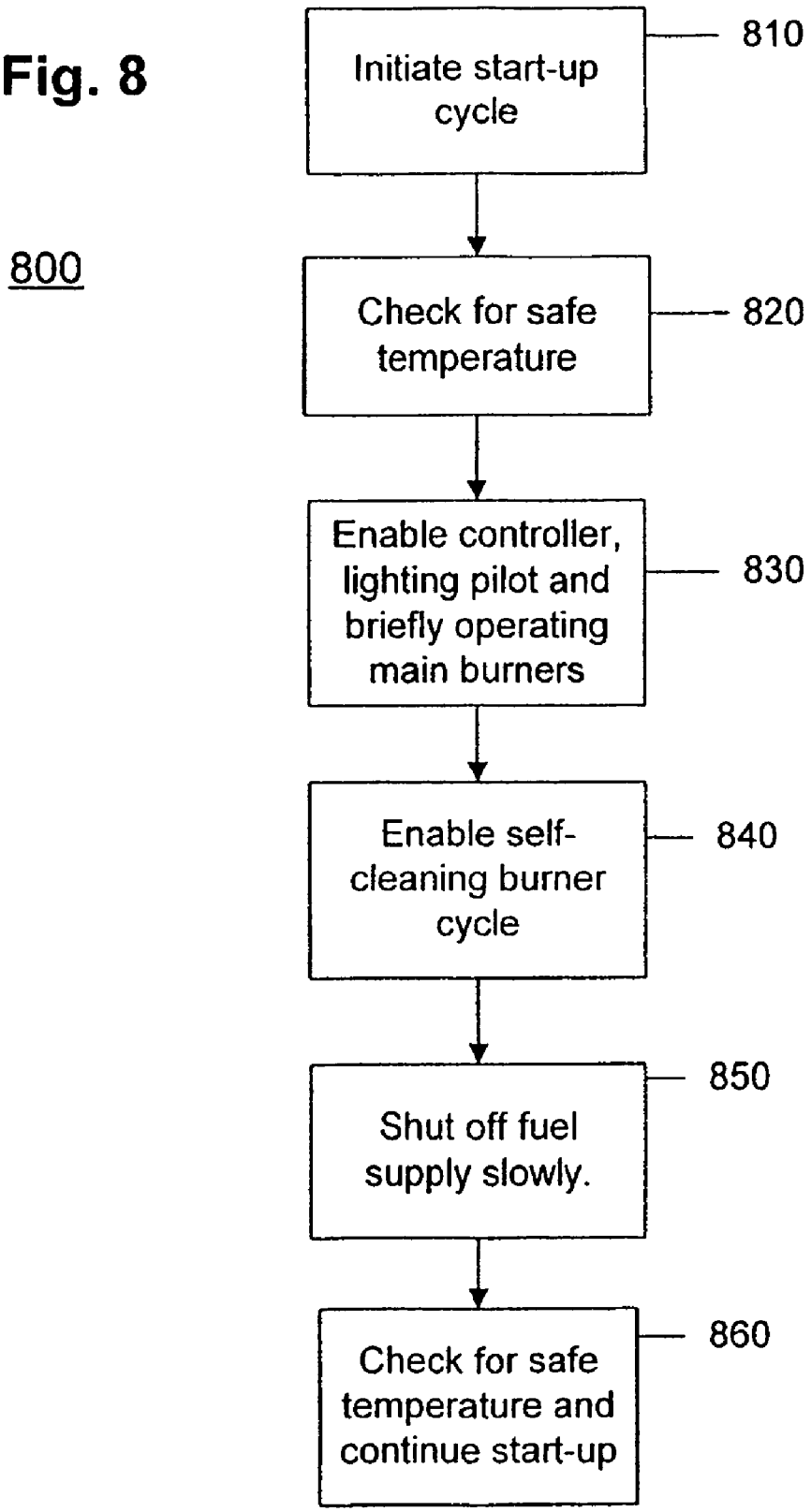
FIGS. 8-9 are flow charts for methods using a self-cleaning burner system.

There are a number of ways of using a self-cleaning burner. A few of the preferred methods are described below. The burner may be part of a larger assembly or appliance, such as a fryer, a water heater, a home furnace, an industrial furnace, an industrial process heater, an oven, a stove, or other heater in which the burner is subject to fouling and the accumulation of debris. Embodiments of the self-cleaning burner may be used in atmospheric burners or in burners using fans and blowers for increased rates of combustion. In one method 800 depicted in FIG. 8, a user begins a start-up cycle 810 for the burner, or for the appliance of which the burner is a part. The self-cleaning cycle is preferably run each time the burner or appliance is started, such as once per day at a start of a day's operation.

The controller makes a safety check 820, such as by checking any temperature elements or temperature indicators for a high temperature. If the safety check is satisfactory, the controller then enables operation 830, and lights the main pilot light or enables an ignition source, and starts one or more burners, preferably all burners. When start-up is achieved, the controller then enables 840 a self-cleaning cycle. A light back is induced by lowering fuel flow or fuel pressure, closing off the fuel supply gradually 850, causing the flame front to move rearward from the combustion zone into the burner, and cleaning the burner by combusting fuel inside the burner itself for a period of time, preferably less than one second. Shutting off fuel to the burner causes the flame to extinguish. The burner control system then checks 860 for low temperatures on any temperature elements or indicators. If the fuel flow has ceased and the flames have extinguished, the temperature element(s) will indicate low temperatures. The burners and the appliance of which the burners are a part may then start up again, without a cleaning cycle, for the day's operation. If the burner runs continuously, such as in a 24 hr per day, 7 day per week cycle, the appliance, heater or burners may be instead programmed to perform a self-cleaning cycle at a desired frequency, such as once or more per day, or once or more per week, as desired. In these instances, the normally-continuous heating operations may be interrupted for a period of time sufficient to cool the burners and temperature elements, a few minutes, and the self-cleaning cycle then run.

Figure 9:
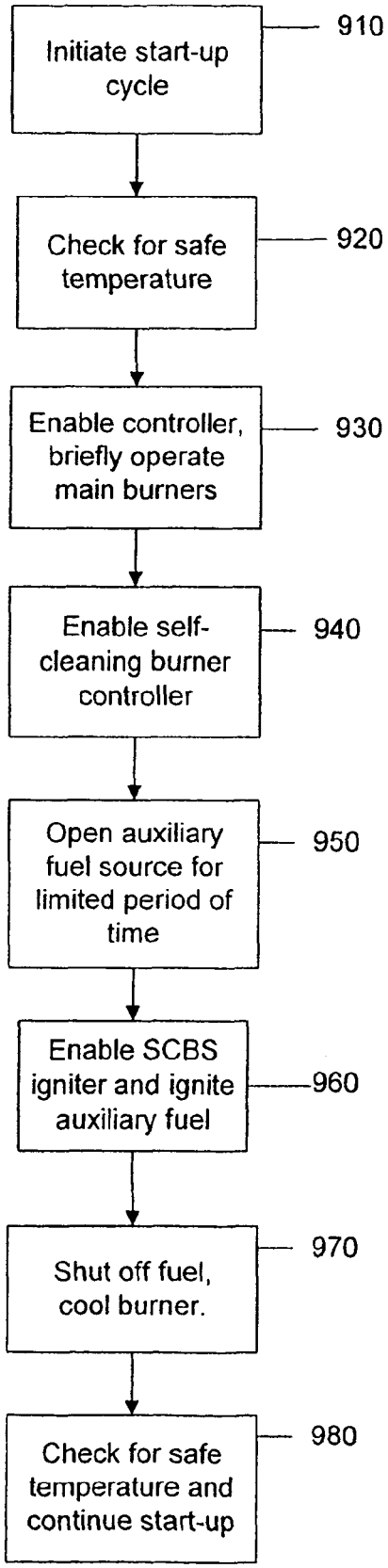

Another method 900 for performing a cleaning cycle is depicted in FIG. 9. In this method, an operator initiates 910 a start-up cycle. The controller makes a safety check 920, such as by checking any temperature elements or temperature indicators for a high temperature. If the safety check is satisfactory, the controller then enables operation 930, and lights the main pilot light or enables an ignition source, and starts one or more burners, preferably all burners. When start-up is achieved, the controller then enables 940 a self-cleaning control cycle. A second valve or other fuel source is opened for a brief period of time 950. A separate igniter for the self-cleaning burner system is enabled 960 and fuel from the auxiliary fuel source, such as a second valve, is ignited, causing ignition near or inside the burner and cleaning the burner. Fuel to the burner is then shut off 970 to allow the flame to extinguish. The burner control system then checks 980 for low temperatures on any temperature elements or indicators. If the fuel flow has ceased and the flames have extinguished, the temperature element(s) will indicate low temperatures. The burners and the appliance of which the burners are a part may then start up again, without a cleaning cycle, for the day's operation.

There are many embodiments of self-cleaning burners according to the present invention, of which only a few have been described herein. There are also many ways of carrying out methods for self-cleaning operations in a burner or burners. It is intended that the foregoing description be regarded as illustrative rather than limiting, and that it is understood that the following claims, including all equivalents, that are intended to define the spirit and scope of this invention.

What is claimed is:

1. A self-cleaning burner system, comprising:

at least one burner in which combustion normally takes place outside the burner at a distal end thereof;

a first valve for connection to a source of fuel, and a first tube having at least one fuel control orifice near a proximal end of the at least one burner, wherein the first tube is connected to the first valve;

a second valve connected in series or parallel with the first valve, and a runner tube connected to the second valve, the runner tube comprising an elongated end portion positioned proximate to and outside of the proximal end of the at least one burner, the runner tube comprises a plurality of holes disposed along a portion of a length of the runner tube including a portion proximate the proximal end of the at least one burner, an ignition source disposed proximate the distal end of the at least one burner and proximate the portion of the length of the runner tube with the plurality of holes; and a controller for controlling an operation of the self-cleaning burner system, wherein the controller is configured to selectively open the first valve and activate the ignition source, the controller is further configured to selectively open the second valve for a short duration of time to supply fuel to the runner tube and admit a flame formed along the length of the outer surface of runner tube into the proximal end of the at least one burner to clean the burner.

2. The self-cleaning burner of claim 1, wherein the controller is selected from the group consisting of a microprocessor controller, a solid state controller, a manual valve, and a selector switch, wherein the controller automatically or manually controls the cleaning cycle.

3. The self-cleaning burner system of claim 1, wherein the ignition source is connected to the controller, and the ignition source is selected from the group consisting of a pilot light, an ignition system, a glow coil, a piezoelectric igniter, a glow wire and a spark plug.

4. The self-cleaning burner system of claim 1, further comprising at least one temperature-sensing device connected to the controller and disposed proximate to the proximal end of the at least one burner.

5. The self-cleaning burner system of claim 1, further comprising a flow-control orifice between the first valve and the at least one orifice.

6. The self-cleaning burner system of claim 1, further comprising an assembly selected from the group consisting of a heater, a water heater, a fryer, an oven, a stove, and a furnace, into which assembly the self-cleaning burner system has been assembled.

7. The self-cleaning burner system of claim 1, wherein the controller is configured to perform a cleaning cycle by initially opening the first valve and activating the ignition source, and then closing the first valve slowly over a brief period of time, wherein a flame from the distal end of the burner travels to the proximal end of the burner, thus cleaning the burner.

8. The self-cleaning burner system of claim 1, wherein the plurality of holes on the runner tube are disposed along substantially the entire length of the runner tube.

9. The self-cleaning burner system of claim 1, wherein the plurality of holes on the runner tube are disposed along the length of the runner tube and the ignition source is disposed proximate a proximal end portion of the runner tube.

10. A self-cleaning burner system, comprising:

a plurality of burners with proximal inlet ends and distal outlet ends each closely and similarly aligned with each other;

a first valve for connection to a source of fuel, and a first tube connected to the first valve and having a plurality of fuel control orifices, each of the plurality of fuel control orifices disposed proximate to the proximal end of one of the plurality of burners;

a second valve connected in series or parallel to the first valve;

a runner tube connected to the second valve, the runner tube comprising an elongated end portion aligned to be proximate to and outside of each of the proximal ends of the plurality of burners, the runner tube further comprising a plurality of holes disposed on at least the elongated end portion;

a first source of ignition disposed proximate the distal ends of the plurality of burners to provide a burner flame extending from the distal end of each of the plurality of burners and a second ignition source disposed proximate a portion of the runner tube with the plurality of holes;

a controller for controlling an operation of the self-cleaning burner system, wherein the controller is configured to selectively open the first valve and activate the first ignition source, the controller is further configured to selectively open the second valve for a short duration of time to supply fuel to the runner tube and activate the second ignition source to create a flame that travels along the holed portion of the runner tube and admit the flame into the proximal end of the plurality of burners.

11. The self-cleaning burner system of claim 10, further comprising at least one temperature-sensing device connected to the controller, and disposed proximate to the proximal ends of the plurality of burners.

12. The self-cleaning burner system of claim 10, wherein the plurality of holes in the runner tube comprise a plurality of holes along the length thereof from a proximal end portion of the runner tube proximate the second valve to the elongated portion and the runner tube, and wherein the second ignition source is disposed near the proximal end portion of the runner tube, and the second ignition source is selected from the group consisting of a pilot light, an ignition system, a glow coil, a piezoelectric igniter, a glow wire and a spark plug.

13. The self-cleaning burner system of claim 10, further comprising an assembly selected from the group consisting of a fryer, an oven, a stove, a furnace, and a heater, into which assembly the self-cleaning burner system has been assembled, wherein the self-cleaning burner system comprises a plurality of burners.

* * * * *